United States Patent [19]

Ruud

[11] 4,399,945

[45] Aug. 23, 1983

[54] POWDER SPRAYER

[76] Inventor: Jan T. Ruud, Fregattgränd 1, 44074 Hjälteby, Sweden

[21] Appl. No.: 221,443

[22] Filed: Dec. 30, 1980

[30] Foreign Application Priority Data

Jan. 4, 1980 [SE] Sweden ..... 8000065
Nov. 12, 1980 [SE] Sweden ..... 8007919

[51] Int. Cl.[3] ..... B05B 5/02
[52] U.S. Cl. ..... 239/697
[58] Field of Search ..... 239/690–699

[56] References Cited

U.S. PATENT DOCUMENTS 3,873,024 3/1975 Probst et al. ..... 239/697 X

*Primary Examiner*—John J. Love
*Assistant Examiner*—Gene A. Church

[57] ABSTRACT

The invention relates to a powder sprayer with electrostatic charging capacity and by means of which in a simple and effective manner by way of example a coloring powder can be electrostatically charged, so that it will be completely charged all over the entire surface of the particles.

The powder sprayer (1) comprises a number of curved charging ducts (6, 6') of long extension made of electrically non-conducting material which ducts are coated with an electrically conducting layer (7) along the main portion of their extension, said coated layer (7) being connected to a conductor (8, 10) intended by way of example to be connected with the ground, whereby a charging of the powder material takes place during its movement through said charging ducts (6, 6') after contact with the inner walls of the ducts (6, 6'), when the sprayer is in use.

10 Claims, 6 Drawing Figures

POWDER SPRAYER

The present invention relates to a powder sprayer with electrostatic conductivity.

It is a principal object of the invention to provide a sprayer, by means of which for example colouring powder in a simple and efficient manner can be electrostatically charged, so that all the surfaces of the particles will be completely charged.

Said object is obtained by means of a powder sprayer according to the present invention, which is substantially characterized by comprising a number of curved charging ducts of long extension and made of electrically non-conducting material, by way of example plastic material, said ducts being coated with an electrically conducting layer along the main portion of their extension, and the coated layers being connected with a conductor, by way of example intended for ground connection, whereby a charging of the powder takes place in connection with the use of the sprayer, when the powder moves through said charging ducts and has been in contact with the inner walls of the ducts.

Figure 1:
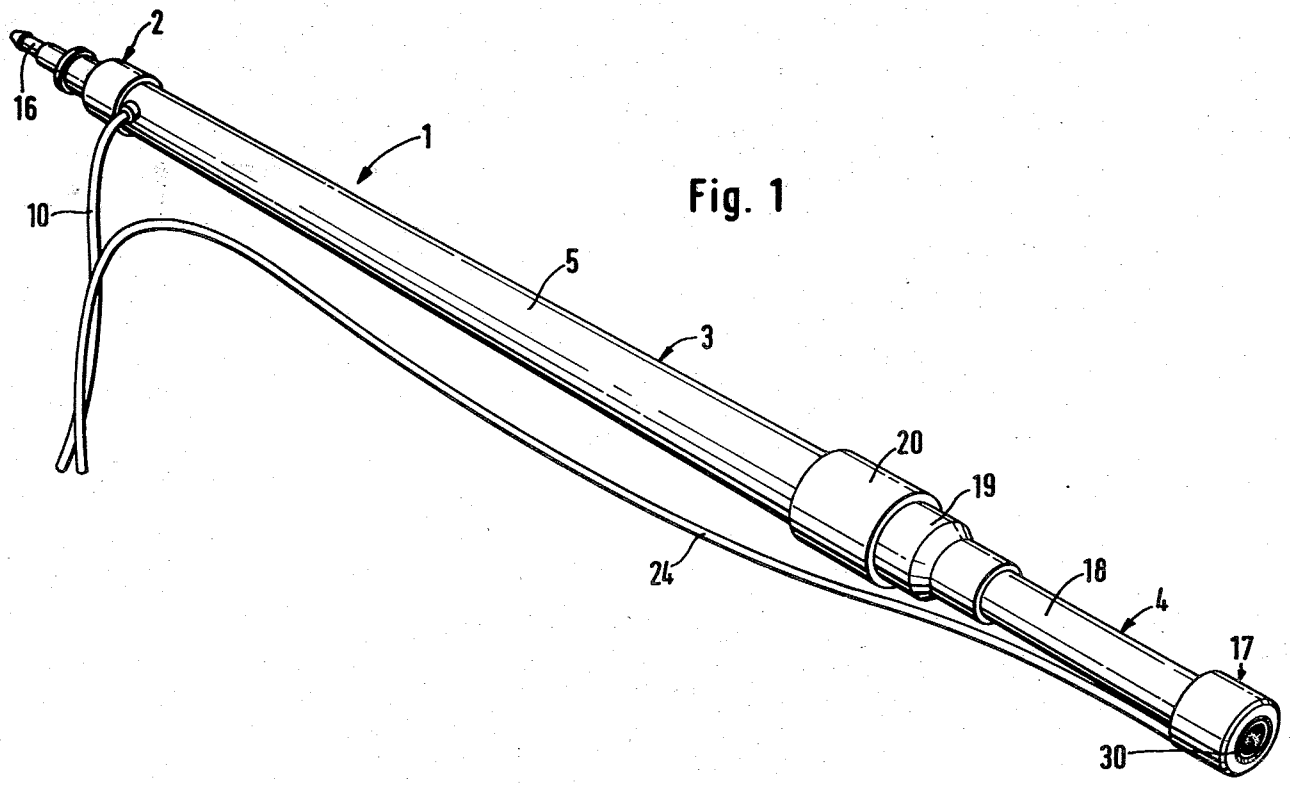
Figure 2:
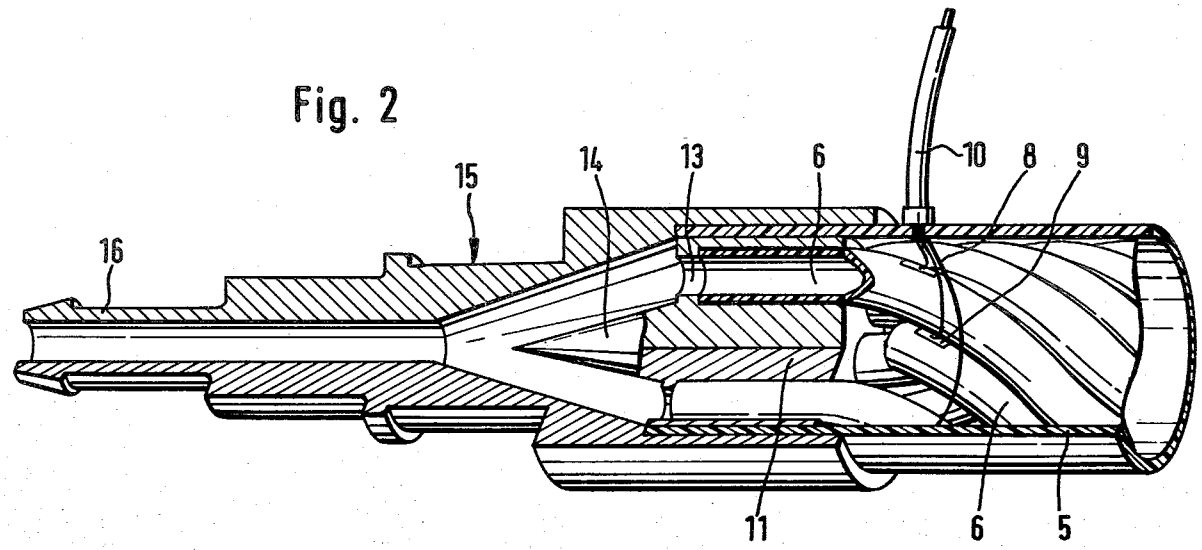
Figure 3:
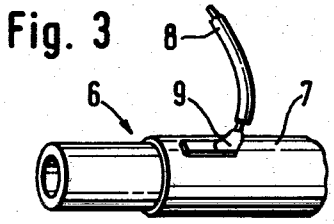
Figure 4:
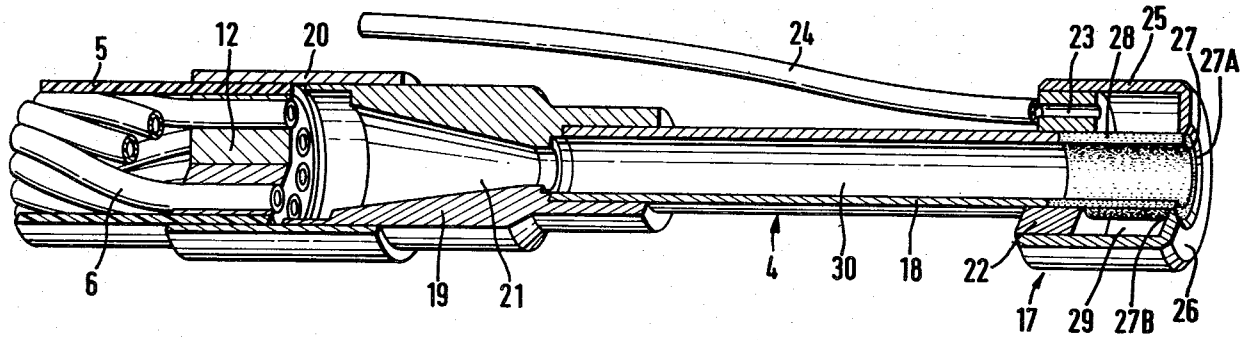
Figure 5:
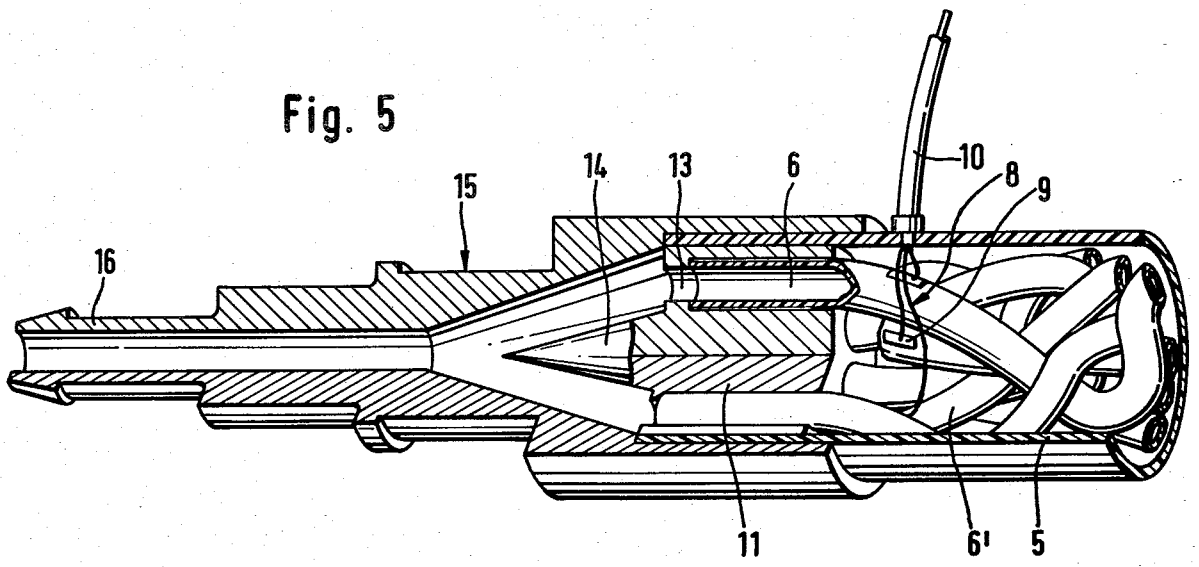
Figure 6:
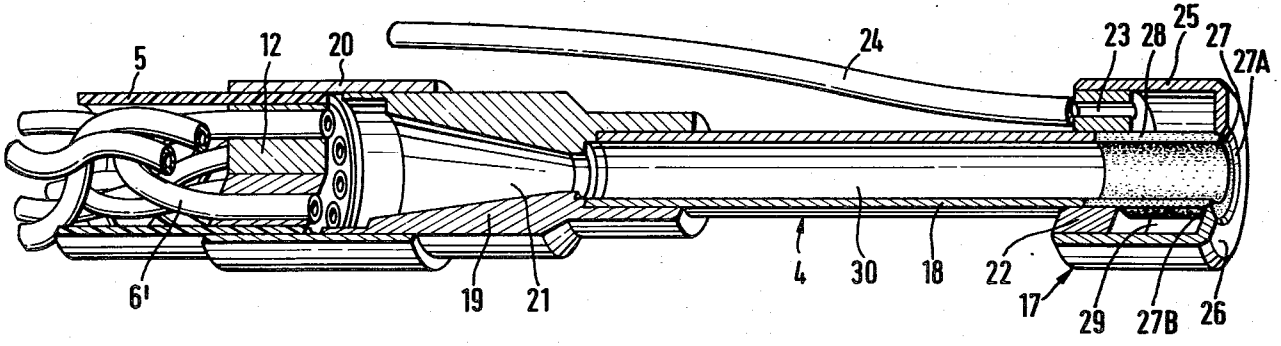

An example of embodiment of the invention will be described in the following, reference being made to the accompanying drawings, in which FIG. 1 is a perspective view of a powder sprayer designed according to the invention, FIG. 2 shows the rear end of the sprayer in partly sectional view, FIG. 3 shows a transportation and charging tube forming part of the sprayer and a conductor connected with this tube, FIG. 4 shows the front end of the sprayer in a partly sectional view, and FIGS. 5 and 6 show the rear end and front end respectively of the sprayer in a partly sectional view according to another example of embodiment.

A powder sprayer 1 designed according to the invention is, as mentioned above, especially adapted for use in connection with powder spraying, the sprayer then preferably being supported and operated by a painting robot. The sprayer 1 comprises substantially three components. A rear component 2 is a connecting component, which can be coupled together with a hose, in which colouring powder is transported from a colour bin. The colouring powder is transported through a mid component 3 at the same time as it is electrostatically charged, and a front component 4 forms the nozzle of the sprayer. The mid component 3 comprises a tube 5 preferably made of plastic material. A core of a number of tubes 6 of long extension but of smaller dimension and helically twisted together are enclosed in said tube 5. Also these small tubes 6 are preferably made of plastic or some other nonconducting material. A layer of metal 7 or any other conducting material surrounds each one of these charging tubes 6, as is evident from FIG. 3. At the rear end of the charging tubes 6, as seen in the direction of transportation, there is a conductor 8 connected to said metal layer 7, by way of example by means of a soldered joint 9. These conductors 8 converge and blend into a common conductor 10, which is led through an opening of the outer tube 5 to the outside of the tube and can be grounded or connected to a power source. Each one of the terminal ends of the charging tubes 6 are introduced into a circular core, a rear core 11 and a front core 12 respectively. These cores 11, 12 along their periphery have a number of through openings 13, which are interspaced in a ring-shaped arrangement and adapted to the respective charging tubes 6. A cone 14 is provided in the centre of the rear core 11 and points in a direction against the direction of transportation, said cone functioning as an atomizer for the powder rushing in. The rear end of the outer tube 5 supports a sleeve 15, which at the one of its ends pointing away from the tube 5 is provided with connections 16 for coupling together the colour sprayer 1 and a hose, in which colouring powder is transported from a colour hopper. The nozzle 4 is attached to the opposite end of the tube. This nozzle component 4 comprises a spray nozzle 17, a connecting tube 18 and a throttle sleeve 19. The throttle sleeve 19 is with its rear end by means of a coupling sleeve 20 connected with the charging tubes 6 and surrounds the front end of the outer tube 5 and has a conically tapering through-passage 21 extending in a direction away from said tube, in which passage the charged powder is guided towards the central axis of the sprayer 1 and the nozzle 17. The connecting tube 18 is with its rear end introduced into and held by the throttle sleeve 19. A connecting ring 22 is threaded onto the tube 18 at its front end, and said ring 22 in its turn supports said sprayer nozzle 17. The connecting ring 22 is traversed by an axial duct 23, which at its rear end is connected with a hose 24 for the supply of gas, by way of example air. The nozzle 17 comprises a sleeve 25, which at its front end supports an end wall 26, which is provided with an opening 27 in central position. This opening 27 has a chamfered edge 27A on its outside and a stepped shoulder 27B on its inside. The front end of a diffuser 28 is fitted into this stepped shoulder 27B, said diffuser having the form of a tube made of porous permeable material transmitting the air, by way of example manufactured in a sintering process. The rear end of the diffuser 28 is threaded into the connecting ring 22 and bears against the front end of the connecting tube 18. Gas, that is introduced at an overpressure through the duct 23 of the connecting ring, flows into the chamber 29 formed between the nozzle 17 and the diffuser 28, whereafter it is subsequently spread through the small openings existing in the porous material, of which the diffuser is made, before it flows into the front portion of the through-duct 30 of the nozzle 4. During this phase an overpressure is created in the front portion of the nozzle, the powder and the gas current being compressed in order to expand and form a mist, when the mixture emerges out of the nozzle 17. By variation of this overpressure the spreading of the powder can be regulated.

The function of the colour sprayer described above will now be described more in detail. The sprayer 1, as mentioned above, is with its rear end 16 by means of a hose connected with a colour hopper. The colour powder is by means of an air stream transported through the rear portion 2 of the sprayer 1 and by means of the cone 14 spread in outwards direction, so that it flows in through the openings 13 of the core 11 and further in through the charging tubes 6. As mentioned above, these tubes 6 are either connected with the ground or with a power source, by way of example a high tension power source, by means of the conductors 8, 10. On account of the helical form of the charging tubes 6 the powder whirls around in them during the transportation, and all sides of the particles will arrive in contact with the walls of the tube. When emerging out of these charging tubes 6 the powder is thoroughly charged. After emerging from these tubes 6 the flow of powder is throttled by the throttling component 19 and is led through the connecting tube 18 to the spreading nozzle 17 through the flow duct 30. As has already been described, the powder is mixed with the air flowing in through the duct 24 and the diffuser 28 and is compressed in order to expand when flowing out of the orifice of the nozzle 27, as has been described above. The powder will then be spread in the form of a mist, and on account of its electrostatic charge it will find a way to the object, which shall be painted, and stick to the same. Also parts of the painting object, which are difficult to reach, will be covered with colour.

The powder sprayer, which is shown in FIGS. 5 and 6, is of similar design as the sprayer described above, and such parts as are common for the two examples of embodiment are indicated with the same reference numbers.

As distinguished from the earlier described sprayer the sprayer according to FIGS. 5 and 6 is provided with charging ducts 6' of irregular curvature instead of helically curved ducts. Each duct 6' extends in a number of different planes, as is for example shown in the FIGS. 5 and 6.

The function of this powder sprayer is the same as the function of the sprayer described above. The powder, which is led through the sprayer and its charging ducts 6', will be effectively charged during the movement of the powder through said charging ducts 6' after whirling around and contacting the inner walls of said ducts 6'.

The invention is not limited to the embodiments described above and illustrated in the drawings, but can be varied as to its details within the scope of the following claims.

I claim:

1. Powder sprayer (1) with electrostatic charging capacity, the powder sprayer including a discharge nozzle (4), characterized by comprising a number of tortuously curved charging ducts (6,6') of long extension and made of electrically non-conducting material, by way of example plastic material, particle charging means for electrostatically charging the powder material during the movement of the powder material through said charging ducts (6,6') prior to entering the discharge nozzle, said charging means including electrical coating means on the outer surfaces of said ducts, said electrical coating means extending along the main portion of the extension of said ducts, said charging means further including a conductor (8, 10) for ground connection or for powder source connection, said charging means being located essentially completely within the spray gun and effecting charging of powder flowing through said ducts by contact between the powder and the inner walls of the ducts when the sprayer (1) is in use.

2. Powder sprayer according to claim 1, characterized by the conducting layer (7) comprising a metal layer (7), which is provided on the outside of the ducts (6, 6').

3. Powder sprayer according to either one of the claims 1 or 2, characterized by the conductor (8) being connected to the ducts (6, 6') at the one end of them located contraflow to the direction of transportation.

4. Powder sprayer according to claim 3, characterized by each one of the ducts (6, 6') having conductors (8) and by these conductors converging and blending into a common conductor (10).

5. Powder sprayer according to claim 1, characterized by the ducts (6, 6') at their respective ends being received and enclosed in a holding core (11, 12) with the ducts (6, 6') being interspaced in annular arrangement along the periphery of the same.

6. Powder sprayer according to claim 5, characterized by the holding core (11), which is located at the rear end of the ducts (6, 6') and consequently also at the rear end of the sprayer, in its backwards facing portion having a spreading means (14), by way of example in the form of a cone (14), located at the central portion of the core (11).

7. Powder sprayer according to claim 1, characterized by the ducts (6, 6') being completely enclosed in a common for example tubeshaped casing (5).

8. Powder sprayer according to claim 1, characterized by having a narrowing portion (19), by way of example a cone-shaped part (21), located in the area surrounding the discharge openings of the ducts (6, 6').

9. Powder sprayer according to claim 1, characterized by the charging ducts (6') having an irregular curvature.

10. Powder sprayer (1) with electrostatic charging capacity, characterized by comprising a number of tortuously curved charging ducts (6,6') of long extension and made of electrically non-conducting material, by way of example plastic material, said ducts being coated with an electrically conducting layer (7) along the main portion of their extension and said coated layers (7) being connected to a conductor (8, 10), said sprayer further including a common duct to which said charging ducts are connected to discharge powder into a rear end of said common duct, and an atomizer means located in said common duct, said atomizer means having powder spreader means thereon to spread powder flowing therepast in an outward direction.

* * * * *